US007513206B1

(12) United States Patent
Knoos

(10) Patent No.: US 7,513,206 B1
(45) Date of Patent: Apr. 7, 2009

(54) SAILBOAT SERVO-PENDULUM STEERING SYSTEM

(76) Inventor: Stellan Knoos, 5931 Avenida Chamnez, La Jolla, CA (US) 92037

( * ) Notice: Subject to any disclaimer, the term of this patent is extended or adjusted under 35 U.S.C. 154(b) by 176 days.

(21) Appl. No.: 11/384,084

(22) Filed: Mar. 17, 2006

(51) Int. Cl.
*B63H 25/00* (2006.01)
*B63H 25/04* (2006.01)

(52) U.S. Cl. ..... 114/144 C

(58) Field of Classification Search ..... 114/144 C, 114/144 R, 162, 164–168
See application file for complete search history.

(56) References Cited

U.S. PATENT DOCUMENTS 3,880,104 A * 4/1975 Saye ..... 114/144 C
3,903,828 A * 9/1975 Green ..... 114/144 C
3,983,831 A * 10/1976 Knoos et al. ..... 114/144 C
4,327,657 A * 5/1982 Knoos ..... 114/144 C
4,766,833 A 8/1988 Knoos
5,309,858 A 5/1994 Knoos

FOREIGN PATENT DOCUMENTS

GB 2080227 A * 2/1982
GB 2390350 A * 1/2004

* cited by examiner

*Primary Examiner*—Ajay Vasudeva
(74) *Attorney, Agent, or Firm*—Edward Sokolski; Don B. Finkelstein

(57) ABSTRACT

A self steering system for a sailboat has a rotatably and pendulously supported servo blade or "oar" member, which is suspended in the water behind the boat. A central body portion is attached to the transom of the boat. A pendulum body having two lever arms or "winglets" which extend generally in opposite directions is fixedly supported on a shaft suspended below the central body portion. A line is attached to each of the tips of the lever arms. Each of these lines runs upwardly and through separate blocks to the boat's steering control. A wind vane is installed on the top of the assembly and drives a push rod, which is coupled, to the servo blade. In operation, the wind vane provides a motional signal in accordance with changes in the heading of the boat from a preset heading, this motional signal operating to drive the servo blade, which controls the sailboat's main rudder, to bring the boat back to its preset heading.

10 Claims, 8 Drawing Sheets

12
20
19
30
10
11
1
30

25
12
2
9
50
13
26
7
14
15
47
16
28
29
6
23
5
6
31
24
-3-
21
10
47
8
4
22
27
16
18
17

11
30
1
30
2
50
13
25
9
26
10
58
7
8
57
59
14
24
23
5
60
5
15
62
21
16
4
22
61
63
64
17

SAILBOAT SERVO-PENDULUM STEERING SYSTEM

BACKGROUND OF THE INVENTION

1. Field of the Invention

This invention relates to self steering systems for sailing craft and more particularly to such a system which employs a rotatably and pendulously supported oar member which is suspended in the water stream behind the craft which is used to control the sailing craft in response to a device such as a wind vane which senses and provides an output signal in accordance with changes in boat heading from a preset heading relative to the wind direction.

2. Descriptions of the Related Art

Self steering systems for sailboats are described in my prior U.S. Pat. No. 3,983,831 issued Oct. 5, 1976; U.S. Pat. No. 4,327,657 issued May 4, 1982; U.S. Pat. No. 4,766,833 issued August, 1988; and U.S. Pat. No. 5,309,858 issued May 10, 1994. Each of the systems described in the above patents employs a different implementation, which makes for some advantage in operation or fabrication. The present invention is most closely related to the device of U.S. Pat. No. 5,309,858 and will therefore be compared in its implementation to that of this patent.

The system of U.S. Pat. No. 5,309,858 employs a pendulum body rotating on a fixed pendulum shaft. The pendulum shaft is attached to a universal bracket, which is fixedly attached to the transom of the sailboat. The system has a major upright section, which includes a base and a tubular wind vane support extending upwardly from the base. This wind vane support is secured to the pendulum shaft and positioned aft of the pendulum body. An output "pull-pull" line attachment shoulder or rocker is positioned on the top of the pendulum body, above the pendulum shaft. Pull-pull output lines run to a set of blocks positioned on opposite sides of the attachment shoulder.

It has been found that the location of the pull-pull lines in prior art systems obstructs swim ladders and "walk-thru" features of the boat. In addition, it has been found to be difficult to correctly position the "pull-pull" line side blocks with double ended boat geometry, a strongly curved boat transom or with off center mountings of the main elements of the system.

Additionally, the pendulum shaft is subject to damage from high accidental mechanical loads from the upright wind vane support, requiring an extra large diameter for the shaft.

A still further disadvantage of this prior art system is that it employs a complex universal bracket which is capable of holding the extra-large pendulum shaft and adapting to a wide range of different transom angles.

SUMMARY OF THE INVENTION

The invention described herein provides an improved and more useful system. It is simpler to manufacture and can be built to have superior strength and lower weight. The system of the present invention, further, is simpler to install than the systems of the prior art and is more suitable for off-center mounting and walk through sailboat transom geometries, which is a desirable feature for most modern sailboats. In addition, in the system of the present invention, the main body of the device of the invention can be attached directly to the sailboat's transom using a simpler bracket which has a universal base. A pendulum body without a shoulder section is suspended with a small diameter pendulum, which is subject to less mechanical loads than prior art systems.

In addition, several of the components of the system can be fabricated from sheet metal rather than through castings. This approach can greatly reduce the cost of manufacture A different pendulum body than that of the prior art is employed. This pendulum body incorporates two side mounted lever arms or "winglets" for pull-pull line attachments, permitting these lines to run upwardly to the blocks, which are secured, directly on the upright section of the system, thus avoiding having obstructing lines on the side of the device. These lever arms or winglets are positioned substantially aft of the pendulum shaft and will pivot or swing free and clear of the center body. A mast tube extension is employed permitting large pendulum swing angles (typically 120-170 degrees to each side). This permits the servo blade to be lifted out of the water and placed in a near upright position for stowage when the system is not in use. The pull-pull lines run substantially upward from the winglets, which keeps them free from interference with other elements of the system. Another significant feature is the provision of a central body, which is substantially flat and can readily be fabricated of sheet metal having substantially higher tensile strength than typical castings and of minimum expense.

DETAILED DESCRIPTION OF THE INVENTION

Figure 1:
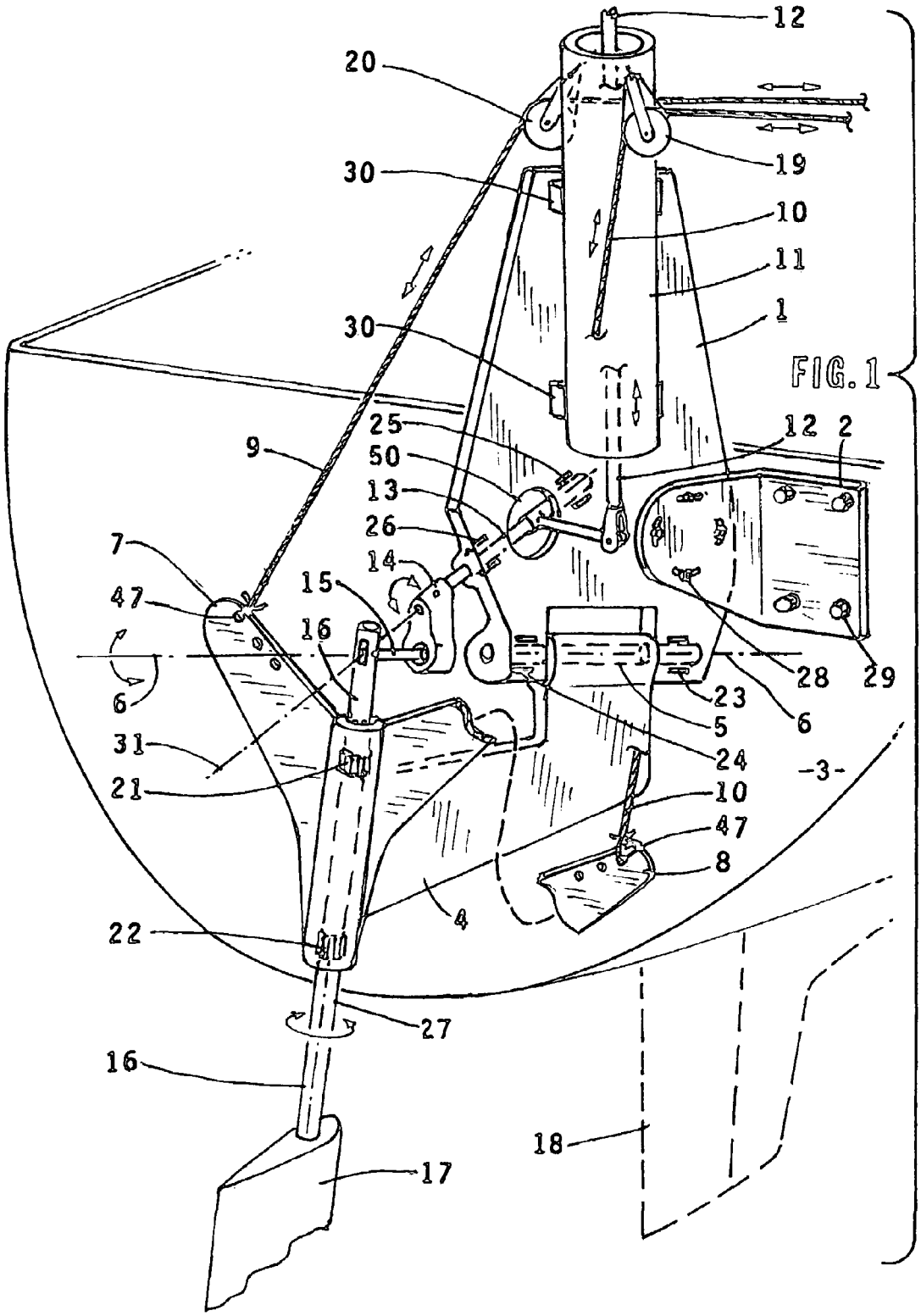
FIG. 1 is an exploded elevational view of a first embodiment of the invention.
Figure 2:
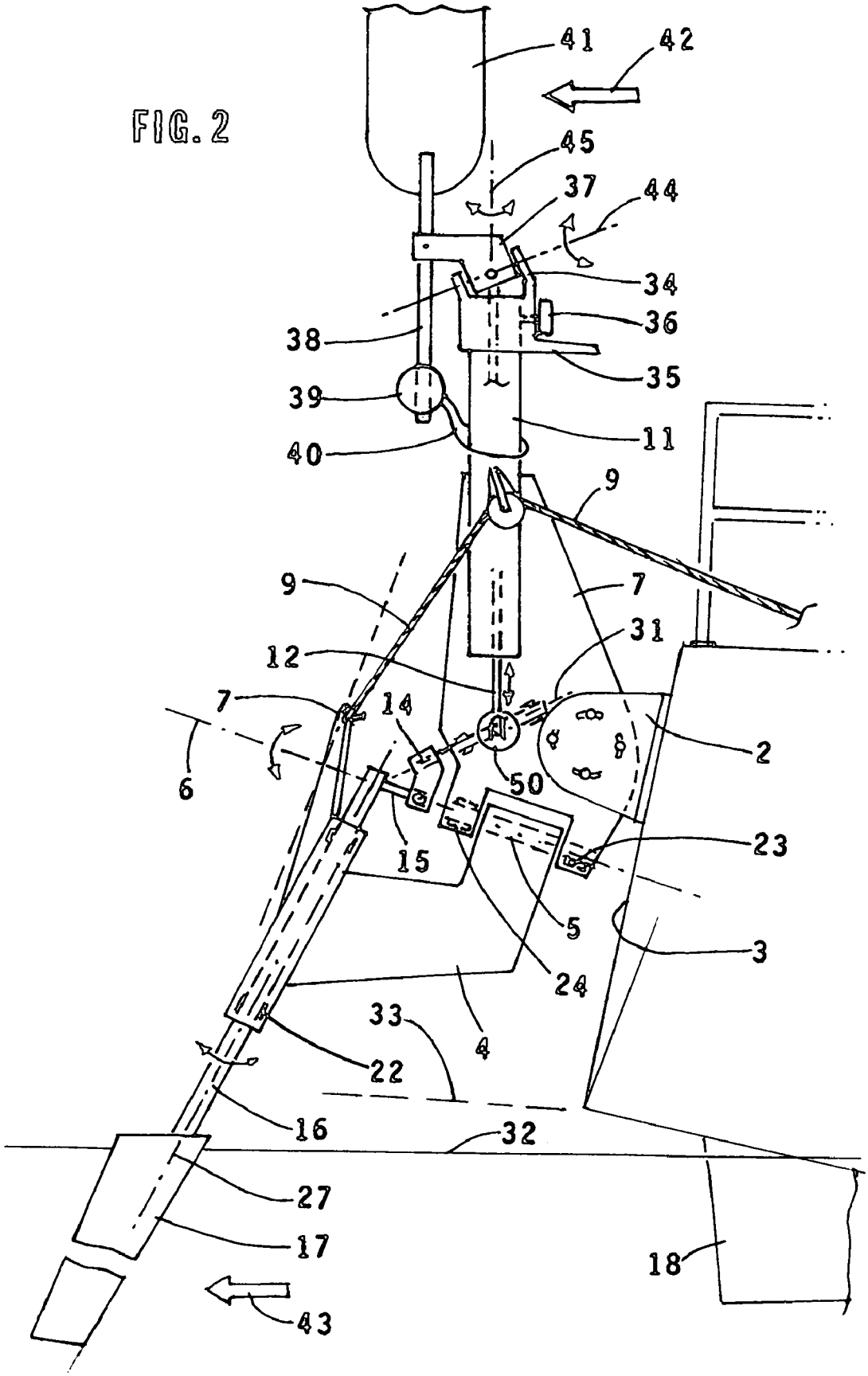
FIG. 2 is a side plan view of the embodiment shown in FIG. 1.

Referring to FIGS. 1 and 2, a first embodiment of the invention is shown.

Central body 1 is a substantially vertical plate, which may be of metal and is substantially parallel to the longitudinal axis of the sailboat. The central body is attached to base member 2 at a desired angle by means of bolts and nuts 28 and the base member is attached to the transom 3 of the yacht in a symmetrical manner by means of four bolts 29 along with washers and nuts. The axis 6 of pendulum body 4 is slanted, as described in U.S. Pat. No. 5,309,858, which is incorporated herein by reference. This slant angle provides the desired stability for the servo blade. The slant angle of axis 6 is typically between 15 and 40 degrees relative to the water surface, which is horizontal. It is to be noted that larger angles provide more "toe-in" for the servo blade and greater stability. It is to be noted that the slant angle of linkage arm 15 to central body 1 does not have to be the sane as for the pendulum axis 6. Often the slant angle of the linkage arm 15 relative to the horizontal is selected to be larger than the slant angle of pendulum axis 6. The "toe-in" angle then becomes larger than dictated by the slant angle for the pendulum axis 6 alone.

The pendulum body 4 is suspended on the shaft 5 beneath the central body 1 and extends aft, a tubular section of the pendulum body having the servo blade shaft 16 installed therein. The pendulum body 4, a lever arm 7 extending to the port side of the boat, and a lever arm 8 extending to the starboard side.

For normal operation of the system of the invention, the rocking motion of the pendulum body 4 is generally limited to 20-30 degrees to each side and thus, as shown in the Figures, the configurations of lever arms 8 and 9, often referred to as "winglets" are simpler and more compact. This is as compared with a larger and heavier circular ring/drum configuration with a V groove device for the pull-pull lines, as is generally found in the prior art.

Mast tube 11 is fixedly secured to central body 1 by means of holders 30. The pull-pull output lines 9 and 10 are attached to the compact lever arms 7 and 8, respectively. The attachment points of the lines to the lever arms are located at substantially equal distances from a region near the interception point of the pendulum axis 6 and the axis 27 of servo blade 17, this region normally being slightly above the interception point of the two axes to avoid both undesirable line slack or line tensioning with motion of the pendulum 4. The output lines 9 and 10 run upwardly and over the blocks 20 and 19 respectively. The blocks are secured to the mast tube 11. The lines then run to the boat's tiller or wheel as shown in FIGS. 1 and 2.

When the self-steering device is not in use, the lines can be disconnected and the line tension released, for example, by the use of cam cleats or stoppers (not shown). The pendulum device can then be allowed to swing up to the maximum possible side angle, which typically can be as high as 160-170 degrees. In the "parked" non-operative position and with the blade 17 or shaft 16 tied to the mast tube 11. The mast tube 11 is secured to the central body 1 using mast tube holders 30.

Push rod 12 runs inside mast tube 11 from the vane assembly 41. The push rod 12 has a forked bottom end, which is connected to a front lever arm, which is connected to rocker shaft 13. Rocker shaft 13 is connected to linkage arm 15 and thus guides the movement of this arm. Linkage arm 15 has a spherical end, which fits into a mating aperture forming a bearing in the hole formed in rocker 14.

In the Figures, the servo blade 17 is shown rigidly attached to blade shaft 16. In the alternative, such attachment can be achieved with a fork holding the shaft to the blade with a breakable shear pin, permitting the blade to fold up backwards or forwards in case of an accidental impact, thereby saving system components from mechanical overload and resultant damage.

The boat's main rudder is shown schematically. Lines 9 and 10 run to the wheel or tiller in a known prior art fashion and control the angle or quadrant of the rudder. The main rudder 18 is the principal steering device for the boat and holds a desired course in response to the wind vector 42 on command from the servo blade 17 and the system which responds thereto.

The servo blade is suspended on the servo blade shaft 16 and oscillates with low friction on bearings 21 and 22 shown in the FIGS as roller bearings. The pendulum shaft 5 is suspended on bearings 23 and 24, which may comprise high load journal bearings. Rocker shaft 13 is suspended on bearings 25 and 26.

The vane assembly, which includes air vane 41, vane base turret 34, vane rod 38, and vane rocker 37, is mounted on the circular top of mast tube 11. The vane base turret 34 can rotate on the circular top of the mast tube. A handle 35 and a locking device 36 for locking the handle in place are employed for course selection and course locking. The vane rocker 37 pivots around the slanted vane pivot axis 44 with pivotal motion being generally restricted to 20-45 degrees to each side of the axis by restricting line 40, which runs around mast tube 11.

The lightweight air vane 41, which is generally larger than servo blade 17, is secured to vane rod 38. Counter weight 39 is balanced and secured to the lower section of vane rod 38. To get high sensitivity with light winds, the joint center of gravity for components 37,38,39, 40, and 41 is placed only slightly below the vane pivot axis 44.

The static waterline of the boat is shown by numeral 32 with a higher dynamic waterline being shown by numeral 33. The water flow vector to the servo blade is shown by numeral 43. The universal base 2 should be positioned and secured to the transom 3 of the boat at such a height that when sailing at full hull speed, the dynamic waterline does not reach the pendulum body 4 or the lower bearing 22 of the servo blade shaft The air vane assembly is fully disclosed the cited prior art and is incorporated herein by reference. The air vane 41 is shown schematically in FIG. 2. The air vane assembly with this prior art configuration generates a downward motion to the pushrod 12 when the boat falls off course to port. When this occurs servo blade shaft 16 is rotated counter clockwise, as seen from above and the servo blade 17 is swung to port. Line 10 is thereby pulled to turn the boat's main rudder so that it generates a hydrodynamic force in the port direction. This causes the boat to make a steering correction to starboard to reach the correct course heading.

Figure 4:
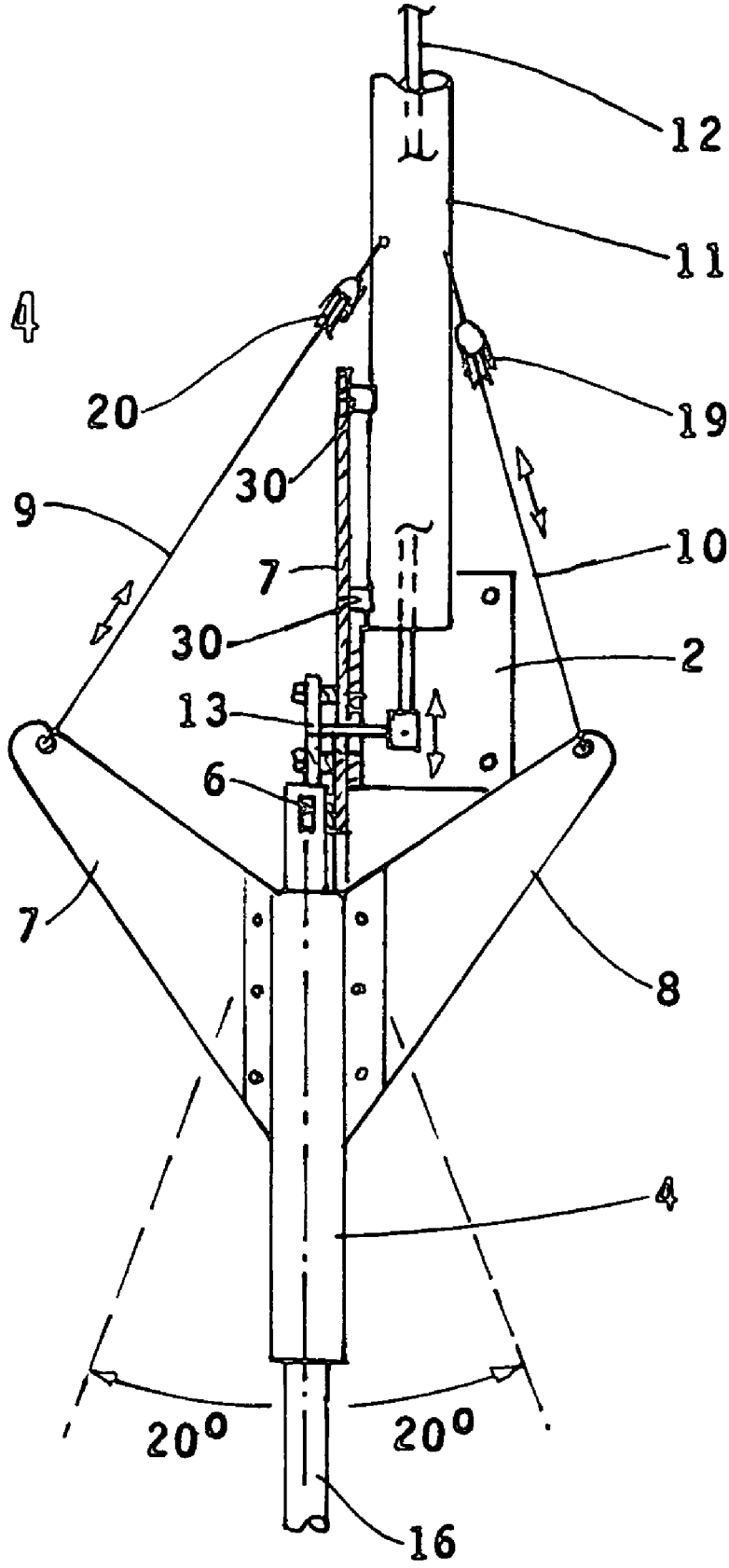
FIG. 4 is a rear elevational view of the first embodiment.

Referring particularly to FIG. 4, a rear view of the system of the first embodiment of the invention is illustrated. Holders for shaft bearings 23,24,25, and 26, shown in FIG. 1 but not show in FIG. 4, are separate parts secured to the central body 1. The mast tube 11 is positioned to the starboard side of plate 1 and held in place by mast tube holders 30. The lever arms (winglets) 7 and 8 are shown as separate parts, which are typically made of sheet metal. Each of the lever arms 7 and 8 is bolted to the pendulum body 4. Universal base 2 here is mounted on the starboard side of central body 1. (See FIG. 1). The rocker shaft 13 and supports for the rocker shaft bearings can be seen in FIG. 1 but are only shown schematically in FIG. 4.

Pull-pull lines 9 and 10 and blocks 19 and 20 are shown in FIG. 4 but reference is directed to FIGS. 1 and 2 for a showing of the line circuits to the wheel and tiller of the boat.

As show in FIG. 4, blocks 19 and 20 are shown secured directly to mast tube 11. It is also possible to secure these blocks directly to the top section of central body 1 or to a separate block holder component secured to the central body or mast tube.

Block positions as well as pull-line attachment positions on the lever arms 7 and 8 relative to the pendulum axis 6 are selected to give desired minimum stretch or slack in the line circuit for the useful pendulum range. Pendulum swing angles of 20 degrees to each side have been found to be suitable for sailboat steering purposes. Pendulum swing angles of 160-170 degrees to the port side and a swing to the starboard side of slightly less are mechanically possible and useful for blade "parking" when not in use and the line circuit is disconnected.

Figure 3:
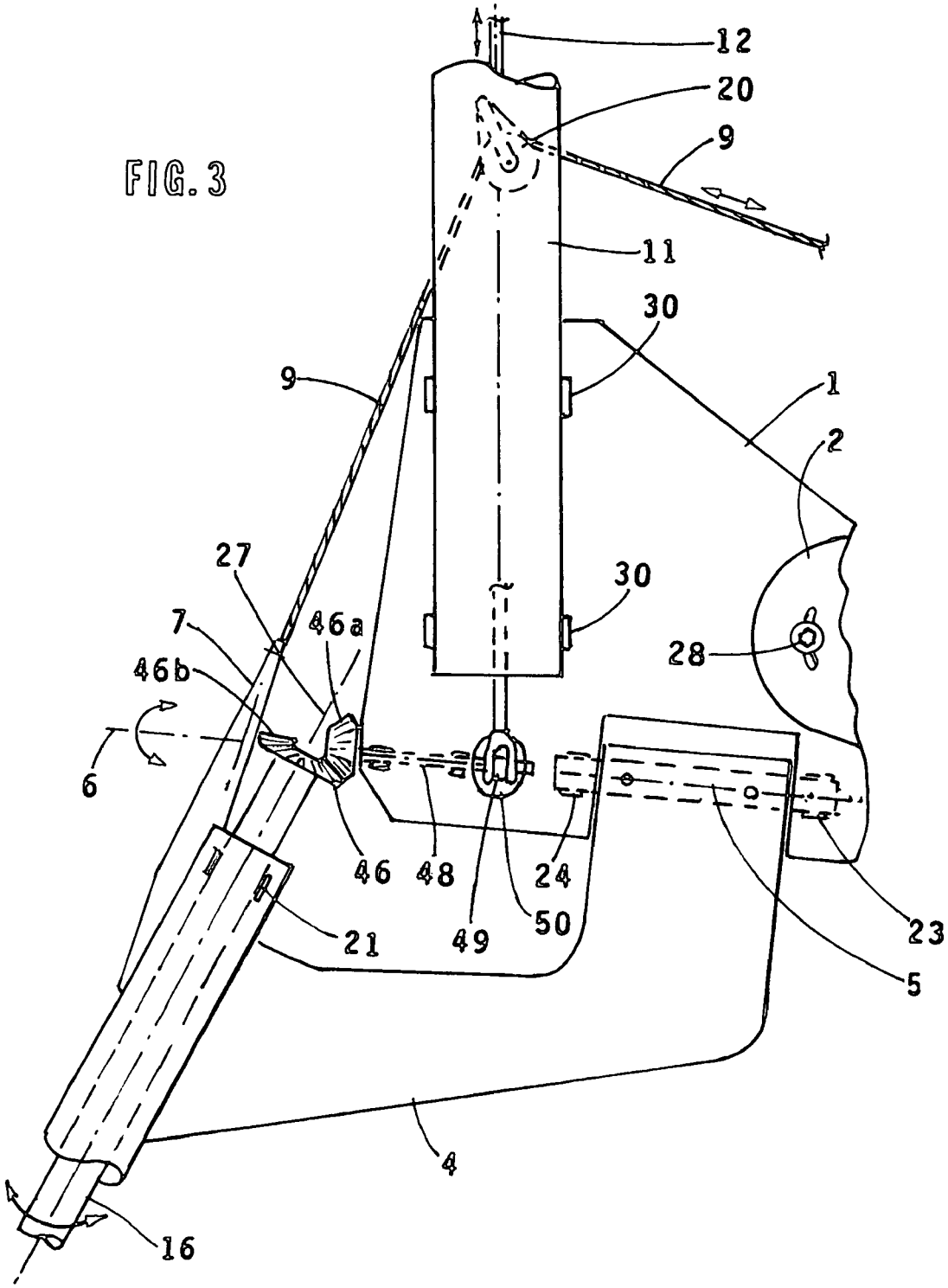
FIG. 3 is a side elevational view of a second embodiment of the invention.

Referring now to FIG. 3, a second embodiment of the invention is illustrated. In this embodiment, the angle of the servo blade shaft 16 and the angle of attack of the servo blade 17 (FIG. 1) is controlled with the help provided by a bevel gear assembly 46. The input bevel gear 46*a* is oriented coaxially with the pendulum axis 6 and the output bevel gear 46*b* is oriented coaxially with the servo blade axis 27.

The angle between the servo blade axis 27 and the pendulum axis 6 need not be 90 degrees. The pitch angles, which are the angles between the pitch cones and the bevel gear axes (half angles of the pitch cones), are normally unequal. The push rod 12 drives a lever 49 connected to the bevel gear shaft 48 thereby rotating the bevel gears.

In the device of FIG. 3, the central body 1 as for the embodiment of FIGS. 1 and 2 can be envisioned as an essentially flat plate with pendulum axis 6, the coaxial pendulum shaft 5 and the coaxial gear shaft 48 all positioned behind the flat plate to the port side, and the mast tube 11 on the front to starboard side. Lever 49 is positioned within an aperture 50 formed in the central body.

Axes 6 and 27 intersect so that the shaft 16 is mounted slightly to the side relative to central plate 1, which can readily be accomplished.

FIG. 3 partially shows only the port side lever 7 and the pull line 9, which runs from lever 7 to block 20. Pull line 10 which runs from starboard side 8 lever 10 to block 19 are not shown in FIG. 3 but can be seen in FIG. 1.

The trajectory of the lever arms 7 and 8 (not shown in FIG. 3 but can be seen in FIG. 1) when the pendulum body swings out are again well behind the central body 1, permitting the desired large swing angles, for example (120-170 degrees to each side without obstruction.

The pull-pull lines 9 and 10 (see FIG. 1 for line 10) are attached to the side sections of rings 47 at geometrically similar but opposite positions relative to the pendulum axis 6 for the side for the side lever configuration as can best be seen in FIG. 1.

With the air vane 41 (see FIG. 2) and push rod 12 in a fixed positions, the oar shaft 16 will turn when the pendulum body 4 swings to the side, providing an angular "toe-in" for the servo blade 17 which assures the necessary hydrodynamic stability for the system. The amount of toe-in for the system shown in FIG. 3 is controlled by selecting the right combination of pitch angles for the bevel gears and slant angle of pendulum axis 6 relative to the surface of the water.

Figure 5:
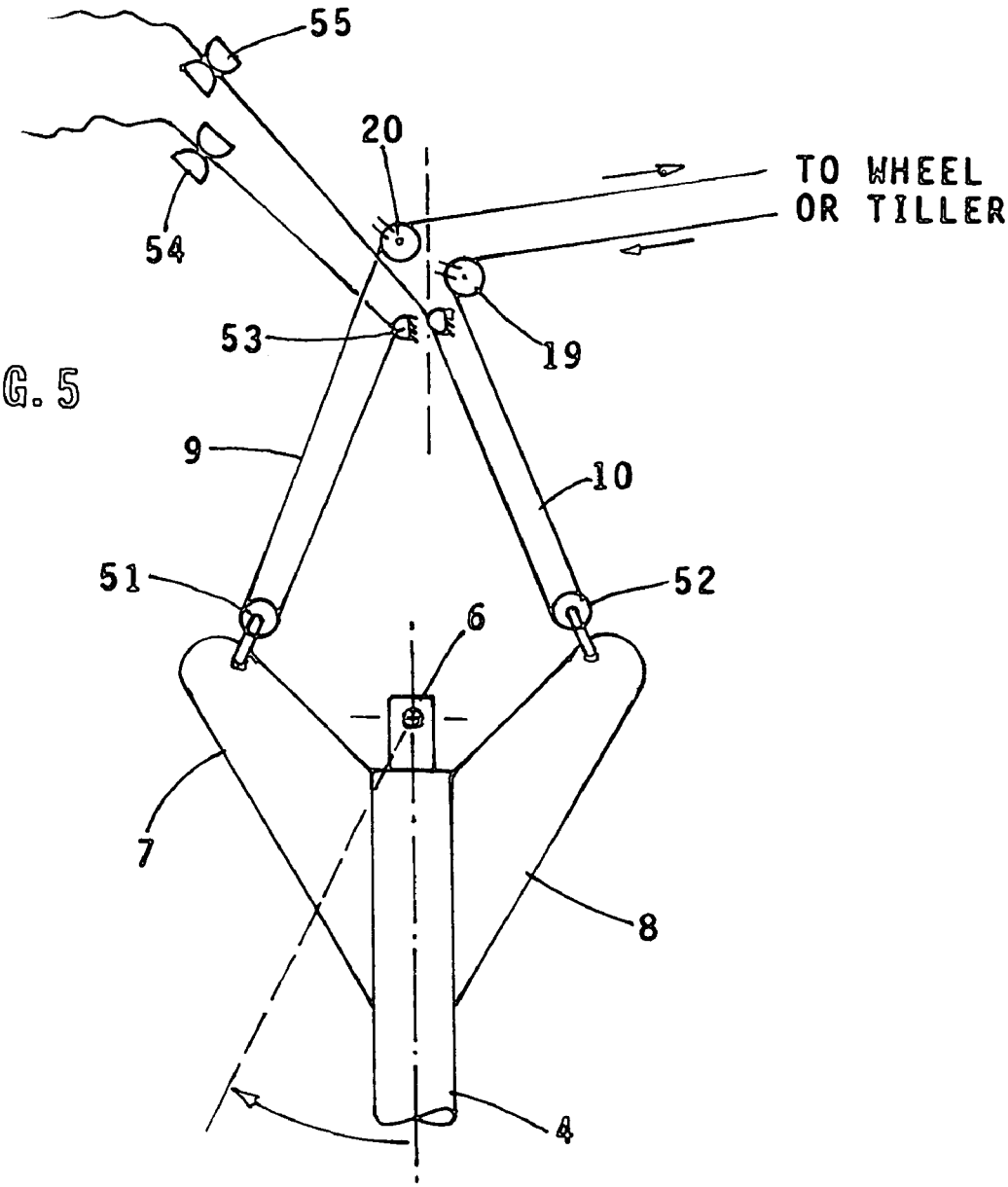
FIG. 5 is a side elevational view of a line circuit configuration for use in the system of the invention.

Referring now to FIG. 5 a practical line circuit configuration for use with the device of the invention is illustrated. This configuration allows for short lever arms arms (winglets) which is highly advantageous. A set of "doubling" blocks 51 and 53 are attached to the tips of the lever arms 7 and 8. As in the previous embodiments, the first set of blocks 19 and 20 are secured to the mast tube 11 or central body 1 (See FIG. 1). A pair of standard cam cleats or standard stoppers 54 and 55 and a pair of pad eyes 53 are employed. With the doubling blocks, the pull line motion is doubled thus allowing for shorter lever arms. The helm line tension or slack can be simply controlled by adjusting the individual line positions in the cam cleats 54 and 55. Rapid release or rapid engagement of the line circuit to the boat's wheel or tiller is also possible using the cam cleats 54 and 55, release being achieved by lifting lines out of the cam cleats and engagement being achieved by installing lines in the cam cleats.

Figure 6:
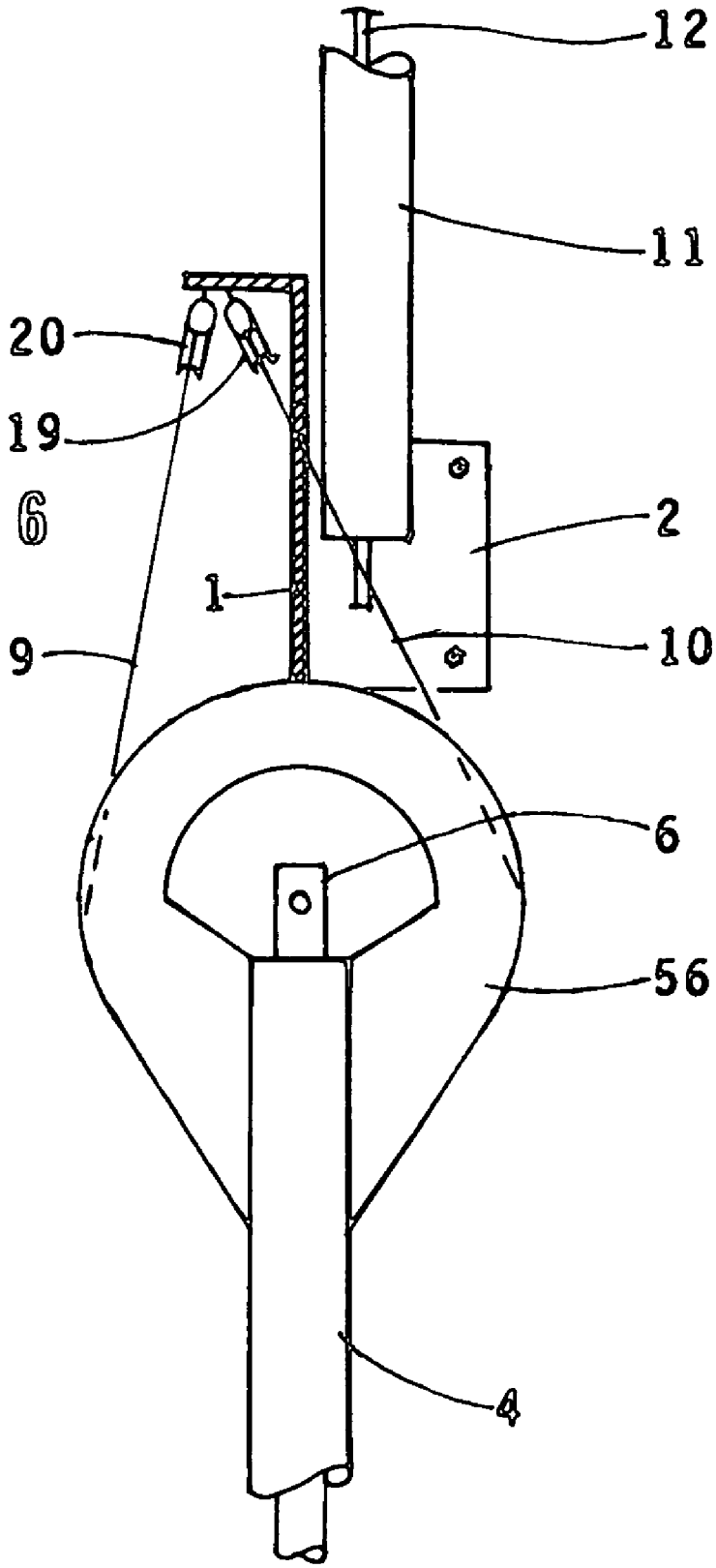
FIG. 6 is a rear elevational view of a third embodiment of the invention, which employs a fully or partially circular drum device rather than lever arms.

Referring now to FIG. 6, a rear view of a third embodiment is illustrated, this embodiment is illustrated, this embodiment employing a partial or full circular drum 56 instead of the lever arms. (port and starboard levers shown in FIG. 1). The drum axis is substantially coaxial with the pendulum axis 6. Lines 9 and 10 are fitted into standard V-grooves in drum 56 and are secured in the bottom section of the drum. The drum is located behind central body 1. The configuration of this embodiment is suitable for use with the linkage arm 15 device shown in FIG. 1 and the bevel gear device 46 shown in FIG. 3. Double blocks (not shown) can be employed along the paths of lines 9 and 10.

Figure 7:
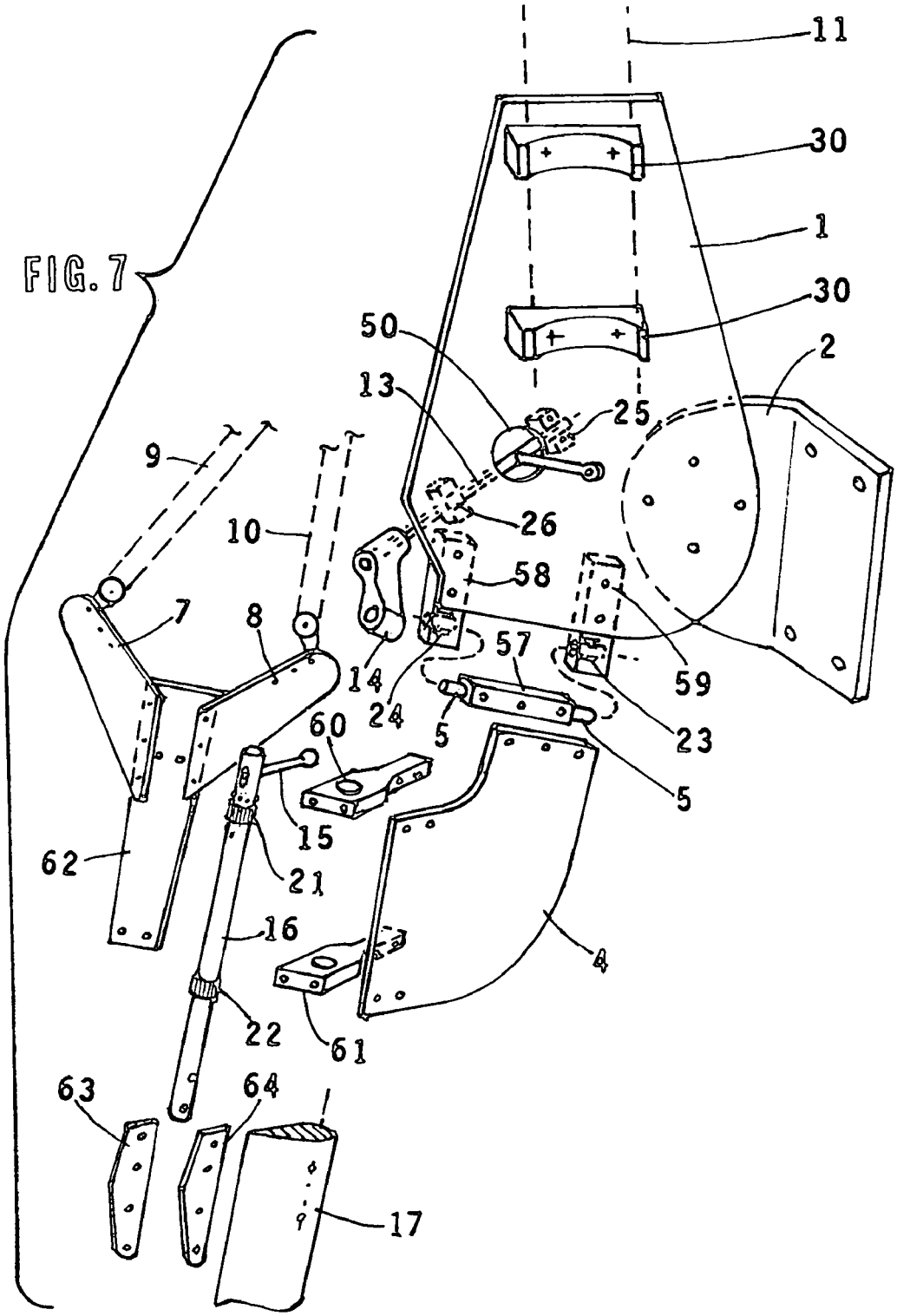
FIG. 7 is a side elevational exploded view illustrating a fourth embodiment of the invention.

Referring now to FIG. 7, a fourth embodiment of the invention is illustrated. This system employs a linkage arm 15 and a rocker 14 in lieu of the beveled gears 46 shown in FIG. 3. The major parts of this embodiment can be manufactured simply and inexpensively from sheet metal and metal bars. A light metal alloy is favored but standard stainless steel can also be employed. Carbon fiber and plastic might also be used.

The central body 1 consists of a flat metal plate with two rectangular bars 58 and 59 attached thereto. The bars have circular holes formed therein for receiving pendulum shaft 5 and pendulum bearings 23 and 24. Push rod 12 and the top of the vane assembly are not shown in this Figure. The pendulum shaft 57 has a rectangular center section, which is bolted to pendulum body 4, and two coaxial end shaft sections 5. The rectangular bars 58 and 59 are bolted to the lower end of central body 1. The pendulum body consists of several parts, which are bolted together. These parts include the sheet metal units 4,7,8, and 62 and the bar parts 60 and 61. The bar parts have holes formed therein for receiving the servo blade shaft 16 with roller bearing elements 21 and 22 on the shaft in engagement with mating gear elements formed in the holes.

The lever arms 7 and 8 with support element 62 make for a stiff and lightweight configuration capable of handling the mechanical loads from the servo blade 17 and the pull lines 9 and 10, Sheet metal element 62 is bolted to bar parts 60 and 61 thus transferring mechanical loads to and from the plate section 4 and from there to and from the pendulum shaft 5.

The servo blade 17 is attached to servo blade shaft 16 employing simple sheet metal fork parts 63 and 64. The fork parts are bolted to the shaft using the two upper bolt holes 17*a* and 17*b*. Servo blade 17 is attached to the shaft between the forks 63 and 64 by means of bolts, the upper one of which can be a shear pin.

Figure 8:
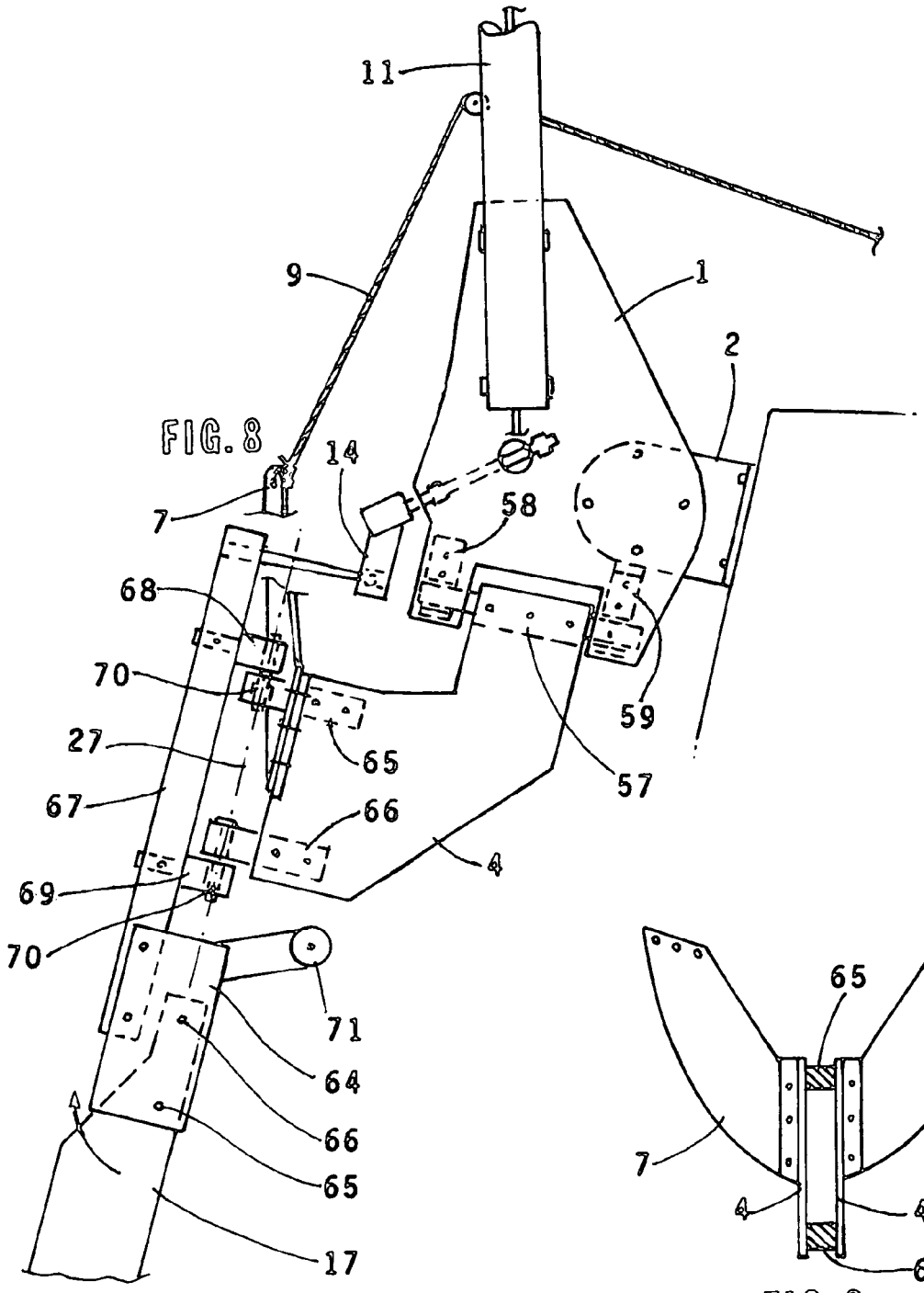
FIGS. 8 and 8A are elevational drawings of a fifth embodiment of the invention.
Figure 8A:
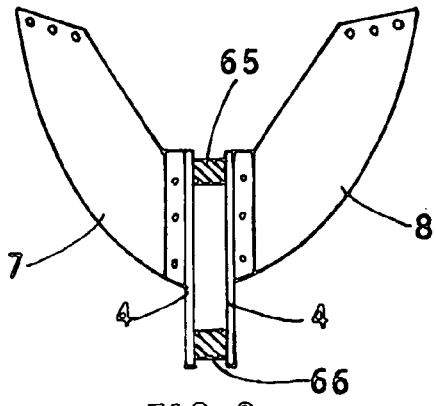

Referring now to FIGS. 8 and 8A, a fifth embodiment of the invention is illustrated. In this embodiment, the pendulum body consists of two separate flat plates 4*a* and 4*b* of equal thickness bolted over elements 65 and 66 and 57. This assembly has higher rigidity permitting the use of plates having smaller thickness. This contributes to weight waving as compared with the arrangement of the other embodiments, which employ a single plate. The servo blade shaft 67 is off center, being located behind axis 27. The servo blade is suspended on two simple hinges without roller or ball bearings. For the side loads. The upper hinge 65 and huge portion 68 has a small diameter pin 70*a* positioned in a sleeve bearing attached to servo blade shaft 67. The lower hinge 66 employs a hinge portion 69, which is retained by means of pin 70*b* in a sleeve bearing attached to servo blade shaft 67.

A counterweight 71 is employed for proper balancing and bringing the center of gravity of the entire assembly including off center shaft 67, fork plates 63 and 64, blade 17 and the counterweight near or ahead of axis 27. This balancing is of importance, particularly in light wind sailing by assisting in the desired stabilizing blade "toe-in" for the pendulum.

The servo blade 17 is held by the two fork plates 63 and 64. The blade is secured by a main holding bolt 65 and a shear pin 66. Upon heavy impact or overload of the servo blade 17 from ahead, the shear pin will break and the blade is permitted to fold backward. The lever arms (winglets). 7 and 8 are bolted to the two pendulum body plates 4*a* and 4*b*. Short sections of the pendulum body plates facing aft are here bent 70-90 degrees outwardly, away from the symmetry plane. Each of the lever arm winglets are bolted respectively to the pendulum bent body sections 4*a* and 4*b*.

While the invention has been described and illustrated in detail, it is to be understood that this is intended by illustration and example only and not by way of limitation, the coverage of the patent being limited by the terms of the following claims.

I claim:

1. A self steering system for controlling the steering of a sailboat through the water in response to the wind direction comprising:

a wind vane;

a mast tube pivotally supporting said wind vane on the upper end of said system;

a servo blade member;

means for pivotally supporting said servo blade member on the lower end of said system in the water behind the rear end of the sailboat;

a central body member supported on the transom of the sailboat, said central body member supporting said wind vane, said servo blade member and said mast tube;

a pendulous member connected to said servo blade member and having a pair of lever arms extending in substantially opposite directions from each other;

a line attached to each of said lever arms, said lines being connected to the tiller or wheel of the boat; and a pair of blocks mounted on said mast tube, each of said lines running over a separate one of said blocks.

2. The system of claim 1 wherein said central body member is in the form of a substantially flat plate.

3. The system of claim 1 and further including a push rod running through said mast tube and connected to said wind vane.

4. The system of claim 3 and further including a servo blade member and a servo blade shaft fixedly attached to said servo blade member, said servo blade shaft being connected to said push rod for motion therewith.

5. The system of claim 4 and further including a rocker arm connected between said servo blade and said push rod.

6. The system of claim 4 and further including a bevel gear assembly connected to said rocker arm.

7. A self steering system for controlling the steering of a sailboat through the water in response to the wind direction comprising:

a servo blade member positioned in the water behind the transom of the sailboat;

a central body portion attached to the transom of the sailboat;

a pendulous member connected to said servo blade member and having two similar lever arms extending in substantially opposite directions;

said pendulous member being positioned beneath the central body portion and the lever arms being positioned aft of the central body portion;

first and second lines each of said lines being fixedly attached to a separate one of said lever arms at the end thereof;

a mast tube fixedly attached to said central body portion and extending upwardly therefrom;

a pair of blocks;

means for supporting said blocks on an upper end of the central body portion;

each of said lines running upwardly and through a separate one of said blocks to the tiller or wheel of the boat;

a wind vane located on top of said mast tube; and means for interconnecting said wind vane and said servo blade member;

whereby when the wind moves from a preset position in response to the wind it provides a mechanical signal to said servo blade member; in response to said signal, said servo blade member steering the boat back to its preset heading.

8. The self steering system of claim 7 wherein the central body portion is in the form of a flat plate.

9. The self steering system of claim 7 wherein said means for interconnecting said wind vane and said servo block member comprises a push rod connected at one end thereof to said wind vane, a rocker arm connected to the other end of said push rod, a second push rod connected at one end thereof to said blade member, the other end of said push rod being connected to said rocker arm.

10. The self steering system of claim 7 wherein said pendulum member has swing angles of at least 90 degrees to each side of center.

* * * * *